US008435318B2

(12) United States Patent
Lee et al.

(10) Patent No.: US 8,435,318 B2
(45) Date of Patent: May 7, 2013

(54) VACUUM CLEANER HAVING DUAL LOCKING STRUCTURE

(75) Inventors: Byung-Jo Lee, Gwangju (KR); Jeong-Hee Cho, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 379 days.

(21) Appl. No.: 12/727,387

(22) Filed: Mar. 19, 2010

(65) Prior Publication Data

US 2010/0281648 A1 Nov. 11, 2010

(30) Foreign Application Priority Data

May 7, 2009 (KR) ..... 10-2009-0039618

(51) Int. Cl.
*B01D 45/18* (2006.01)
*A47L 9/10* (2006.01)

(52) U.S. Cl.
USPC ..... 55/429; 15/352; 15/353; 55/428; 55/DIG. 3

(58) Field of Classification Search ..... 55/429, 55/428, DIG. 3; 15/347, 353, 352, 350
See application file for complete search history.

(56) References Cited

U.S. PATENT DOCUMENTS

| | | | | |
|---|---|---|---|---|
| 2,918,909 | A * | 12/1959 | Nickel | 122/1 B |
| 6,757,933 | B2 * | 7/2004 | Oh et al. | 15/353 |
| 6,782,584 | B2 * | 8/2004 | Choi | 15/352 |
| 7,155,772 | B2 * | 1/2007 | Lee | 15/353 |
| 8,032,983 | B2 * | 10/2011 | Griffith et al. | 15/347 |
| 2006/0213024 | A1 * | 9/2006 | Lee et al. | 15/334 |
| 2007/0266683 | A1 * | 11/2007 | McDowell | 55/429 |

FOREIGN PATENT DOCUMENTS

| | | |
|---|---|---|
| KR | 10-2006-0064768 | 6/2006 |
| KR | 10-2006-0107629 | 10/2006 |
| KR | 10-2006-0116999 | 11/2006 |

* cited by examiner

*Primary Examiner* — Jeanette E. Chapman
(74) *Attorney, Agent, or Firm* — NSIP Law

(57) ABSTRACT

A vacuum cleaner having a dual locking structure is provided. The vacuum cleaner includes a brush assembly, a main body connected to the brush assembly, a dust bin arranged on the main body, a fastening unit to move the dust bin to a fastened or unfastened state, and a filter casing. The dust bin includes one or more first locking holes and the main body includes one or dust bin locking members to be engaged with the first locking holes so that the dust bin, in an unfastened state, is removably retained in the main body. The filter casing includes one or more filter casing locking portions and the main body includes one or more filter casing locking members to be engaged with the filter casing locking portions so that the filter casing in the unfastened state is removably retained in the main body.

7 Claims, 6 Drawing Sheets

VACUUM CLEANER HAVING DUAL LOCKING STRUCTURE

CROSS-REFERENCE TO RELATED APPLICATIONS

This application claims the benefit under 35 U.S.C. §119 (a) of a Korean Patent Application No. 10-2009-0039618, filed on May 7, 2009, in the Korean Intellectual Property Office, the entire disclosure of which is incorporated herein by reference for all purposes.

BACKGROUND

1. Field

The following description relates to a vacuum cleaner, and more particularly, to a vacuum cleaner for domestic, industrial, or commercial use, adopted to prevent or deter undesired separation of a dust bin and a filter casing from the vacuum cleaner.

2. Description of the Related Art

In general, a vacuum cleaner may rotate an air stream containing dusts to thereby separate dusts from the air stream using a centrifugal force of the rotating air. In such a vacuum cleaner, a dust bin and a filter casing may generally be arranged vertically on each other.

The dust bin and the filter casing may be removably secured to the vacuum cleaner by a fastening lever provided in the vacuum cleaner. A user may unfasten the fastening lever and separate the dust bin and the filter casing from the vacuum cleaner.

It is undesirable that the dust bin and the filter casing are separated from the vacuum cleaner unless the user wishes to remove these.

Korean Patent Publication No. 10-2006-116999 ("KR '999"), Korean Patent Publication No. 10-2006-64768 ("KR '768"), and Korean Patent Publication No. 10-2006-107629 ("KR '629") pertain to examples which were suggested to meet the above-mentioned demands.

KR '999 is directed to a structure in which a fastening lever and a sliding portion are formed on a cyclone receptacle, a fastening hook is formed on a dust bin, and a cyclone receptacle guide and a fastening tool are formed on a main body, and is used to separate the cyclone receptacle or the dust bin from the main body, or to secure the cyclone receptacle or the dust bin to the main body.

KR '768 discloses a structure in which a locking device having a restricting portion is provided in a cyclone receptacle, and a locking device receiving portion is formed on a rear side of the vacuum cleaner so that the restricting portion is passed and protruded, and secured therein.

KR '629 discloses a structure in which a fastening hook is protruded from a center portion of a rear surface of a cyclone receptacle, and received in a hook receiving hole of a dust collecting apparatus mounting portion.

The above examples are generally designed to fix a dust bin and a cyclone receptacle in a vacuum cleaner securely.

However, the examples in KR '999 and KR '768 have complicated structures to fix the cyclone receptacle and the dust bin, which may subsequently increase a number of parts of the vacuum cleaner and make fabricating of vacuum cleaners difficult.

All of the examples above may also have a problem where a dust bin and a cyclone receptacle, if unfastened, may undesirably be separated from a vacuum cleaner as the vacuum cleaner is tilted.

Further, all the examples discussed above may have a problem in which it is uneasy to mount or demount a cyclone receptacle and a dust bin individually.

Further, all the examples discussed above may have a problem in which it is difficult or even impossible for a user to mount or demount a dust bin and a filter casing individually.

SUMMARY

In one general aspect, there is provided a vacuum cleaner including a brush assembly, a main body connected to the brush assembly, a dust bin arranged on the main body and comprising one or more first locking holes, a fastening unit configured to move the dust bin to a fastened or unfastened state, one or more dust bin locking members configured to be engaged with the first locking holes so that the dust bin in the unfastened state is removably retained in the main body, a filter casing having one or more filter casing locking portions, and one or more filter casing locking members configured to be engaged with the filter casing locking portions so that the filter casing in the unfastened state is removably retained in the main body.

The first locking holes may be recessed from an outer surface of the dust bin and extend from a lower portion of the dust bin to a predetermined height.

The dust bin locking members may include a dust bin locking protrusion configured to be inserted into the first locking hole, and cutaway portions.

The filter casing locking portions may include a guiding portion configured to guide a horizontal movement of the filter casing locking member, a vertical end configured to restrict a movement of the filter casing locking member, and a filter casing coupling hole recessed upwardly from the vertical end to a predetermined height configured to receive an upper portion of the filter casing locking member.

The filter casing may include one or more second locking holes respectively aligned with corresponding first locking holes of the dust bin when the filter casing is mounted on the main body.

The filter casing may be sealed with the dust bin when fastened by the fastening unit, as an upper surface of the filter casing contacts with a lower surface of the dust bin.

The vacuum cleaner may further include a filter casing fixing rib formed on the main body, and a fixing rib hole formed on a lower surface of the filter casing.

In another aspect, there is provided a vacuum cleaner including a brush assembly, a main body connected to the brush assembly and having a cavity formed therein, a dust bin received in the cavity of the main body, a filter casing received in the cavity of the main body, and a fastening unit to move the dust bin to a fastened or unfastened state. The dust bin and filter casing are removably retained in the cavity of the main body independent of the fastening unit.

The dust bin may include one or more first locking holes and the main body may include one or more dust bin locking members, the dust bin locking members engaging with corresponding first locking holes to thereby removably retain the dust bin in the cavity of the main body.

The filter casing may include one or more filter casing locking portions and the main body may include one or more filter casing locking members engaging with corresponding filter casing locking portions to thereby removably retain the filter casing in the cavity of the main body.

The fastening unit may be positioned on the main body and include a fastening lever.

Upon movement of the fastening lever in one direction, a fastening support portion may move upwardly to thereby move the filter casing in an upward direction into sealing contact with the dust bin, and upon movement of the fastening lever in an opposite direction, the fastening support portion moves downwardly to thereby move the filter casing downwardly and release the sealing contact between the filter casing and the dust bin.

The dust bin and filter casing each may include a handle formed on respective outer surfaces.

The vacuum cleaner may further include a centrifugal separating portion into which an external air stream is drawn, wherein dust separated from the air stream is discharged into the dust bin, and the air stream from which the dust has been separated is discharged from the centrifugal separating portion to the dust bin via a dust bin discharging pipe.

Other features and aspects will be apparent from the following detailed description, the drawings and the claims.

Figure 1:
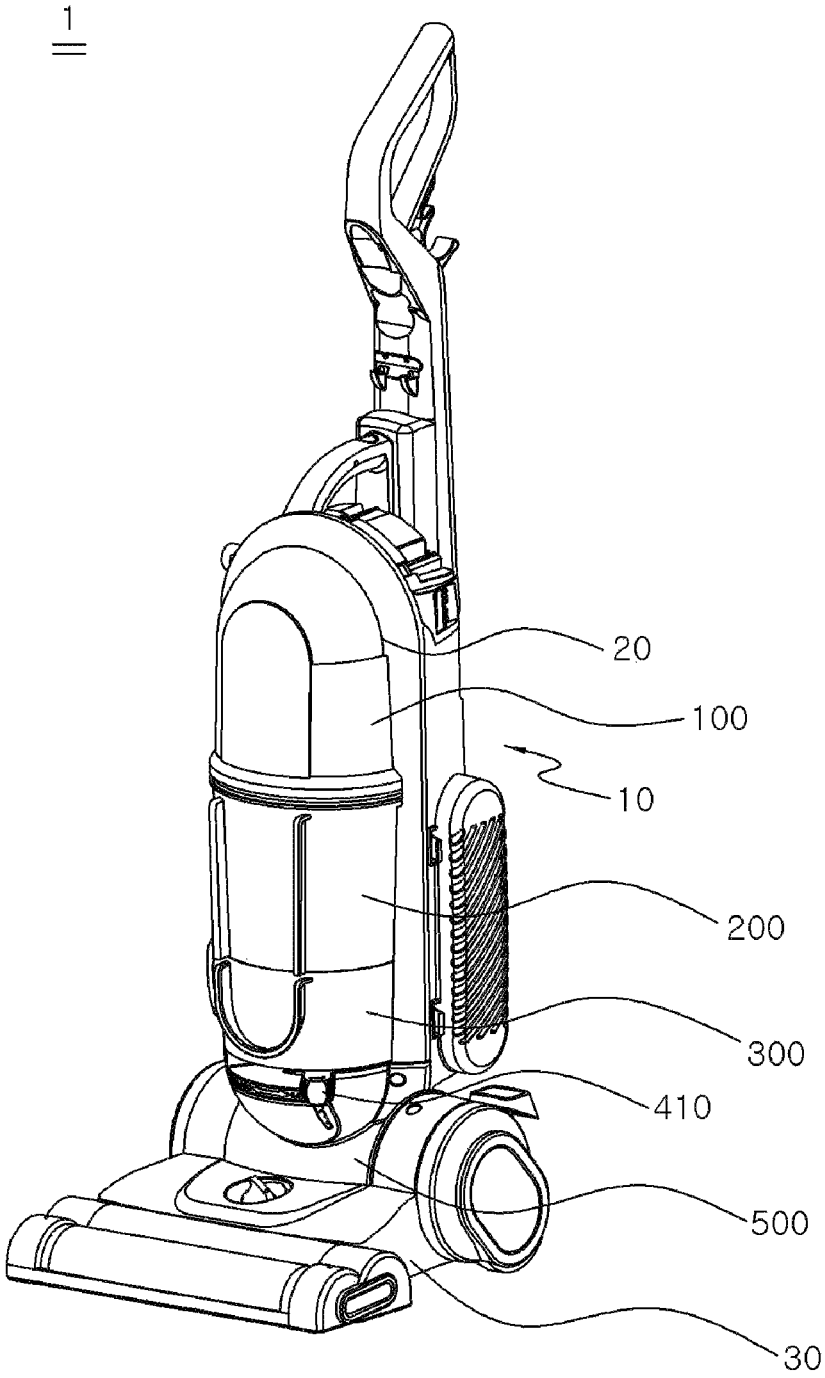
FIG. 1 is a perspective view illustrating an example of a vacuum cleaner having a dust bin and a filter casing mounted therein.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses, and/or methods described herein will be suggested to those of ordinary skill in the art. Also, descriptions of well-known functions and constructions may be omitted for increased clarity and conciseness.

Figure 2:
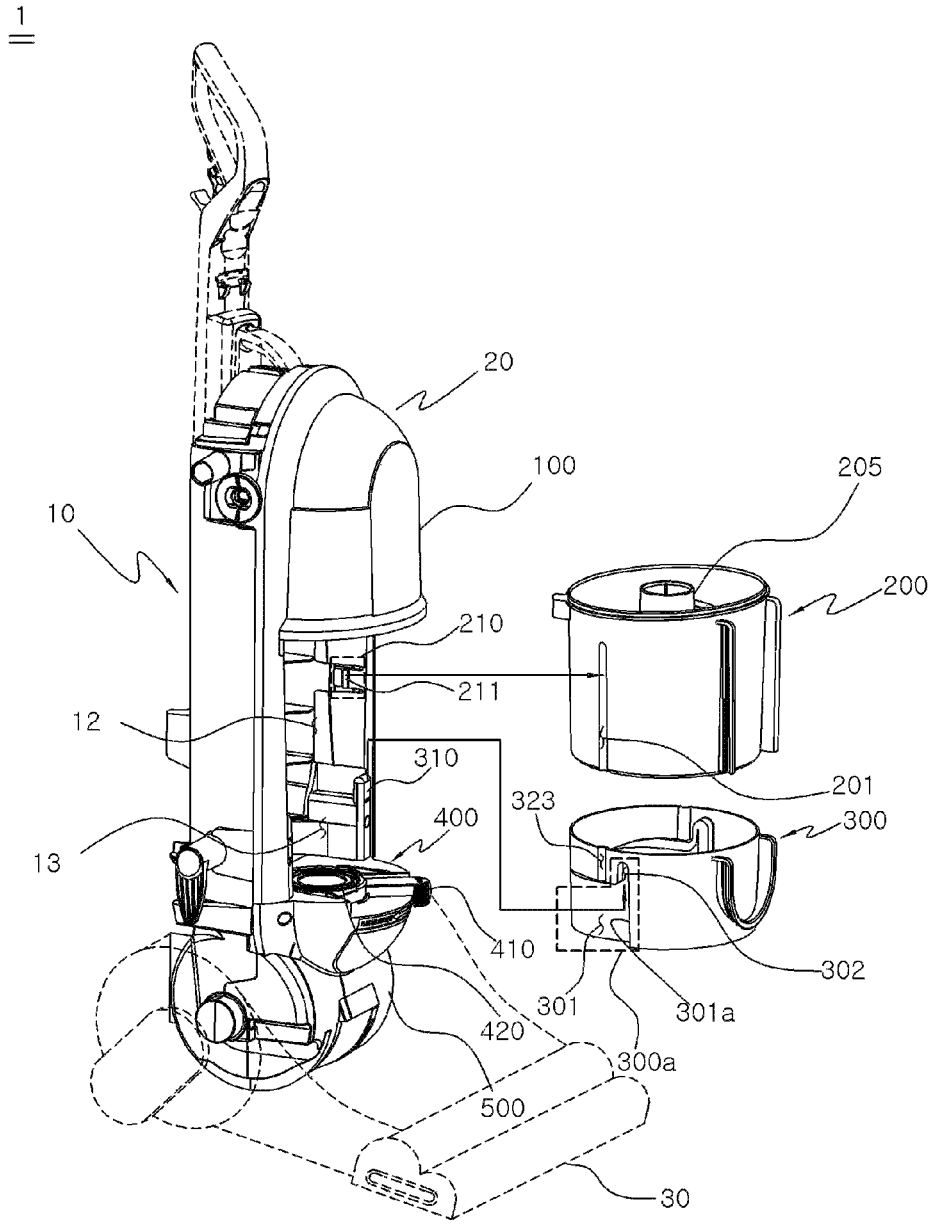
FIG. 2 is an exploded perspective view illustrating an example of the vacuum cleaner of FIG. 1 from which the dust bin and the filter casing are separated.

FIG. 1 illustrates an example of a vacuum cleaner 1 in which a dust bin 200 and a filter casing 300 are mounted. FIG. 2 illustrates an exploded perspective view of the example of the vacuum cleaner 1 of FIG. 1 from which the dust bin 200 and the filter casing 300 are demounted.

Referring to FIGS. 1 and 2, for example, the vacuum cleaner 1 includes a main body 10, a brush assembly 30, the dust bin 200 and the filter casing 300. The dust bin 200 and the filter casing 300 may be mounted in the main body 10.

The main body 10 includes a fan motor unit 500, a centrifugal separating portion 100, a hose nozzle (not illustrated), a fastening unit 400, the dust bin 200, the filter casing 300, and a front cover 20.

The front cover 20 may be mounted on a front surface of the main body 10, to support the centrifugal separating portion 100 and to form a dust bin seating portion 12 and a filter casing seating portion 13. The dust bin 200 and the filter casing 300 may be seated on the dust bin seating portion 12 and the filter casing seating portion 13 respectively, and removably supported by the front cover 20.

The centrifugal separating portion 100 may cause an externally-drawn air stream to rotate such that dust may be separated from the air stream by way of a centrifugal force imparted on the dusts in the rotating air stream. The separated dusts are discharged into the dust bin 200, and the air stream from which dust has been separated is discharged out through a discharging pipe (not illustrated).

The dust bin 200 is positioned below the centrifugal separating portion 100 to collect the dusts separated in the centrifugal separating portion 100, and receive air stream from the centrifugal separating portion 100 through a dust bin discharging pipe 205 fluidly connected to a discharging pipe (not illustrated) of the centrifugal separating portion 100. The dust bin 200 then discharges the air stream to the filter casing 300 positioned therebelow.

The filter casing 300, with a pre-filter (not illustrated) received therein, is positioned below the dust bin 200, to separate minute particles of dusts from the air stream discharged from the dust bin 200, and to discharge the clean air stream from which minutes particles of dusts are removed, to the fan motor unit 500.

In an alternative example, the vacuum cleaner 1 may have a fluid passage which is designed so that the air stream discharged from the fan motor unit 500 is introduced into the filter casing 300. Accordingly, the filter casing 300 is not limited to a pre-filter casing, since the filter casing 300 may have a post-filter accommodated therein.

The fastening unit 400 may move the filter casing 300 mounted on the front cover 20 upwardly to a tight and secure contact with a lower surface of the dust bin 200, if a fastening supporting portion 420 is moved upwardly in accordance with the rotating movement of a fastening lever 410 in one direction. The filter casing 300 may be moved downwardly and the tight and secure contact with the lower surface of the dust bin 200 may be released, if the fastening supporting portion 420 is moved downwardly in accordance with the rotating movement of the fastening lever 410 in the opposite direction.

If the dust bin 200 and the filter casing 300 are released from the tight and secure connection with each other, the user is able to remove the dust bin 200 and the filter casing 300 individually from the front cover 20 or to mount the dust bin 200 or the filter casing 300 individually onto the front cover 20.

In an example of the vacuum cleaner 1, the dust bin 200 and the filter casing 300, released from a secure connection to each other, are not separated from the front cover 20 even when the vacuum cleaner 1 is tilted, due to a dual locking structure arranged between the dust bin 200, the filter casing 300, and the front cover 20.

The dual locking structure of the main body 10, the front cover 20, the dust bin 200, and the filter casing 300 is explained below with reference to FIGS. 3 to 5, for example.

Figure 3:
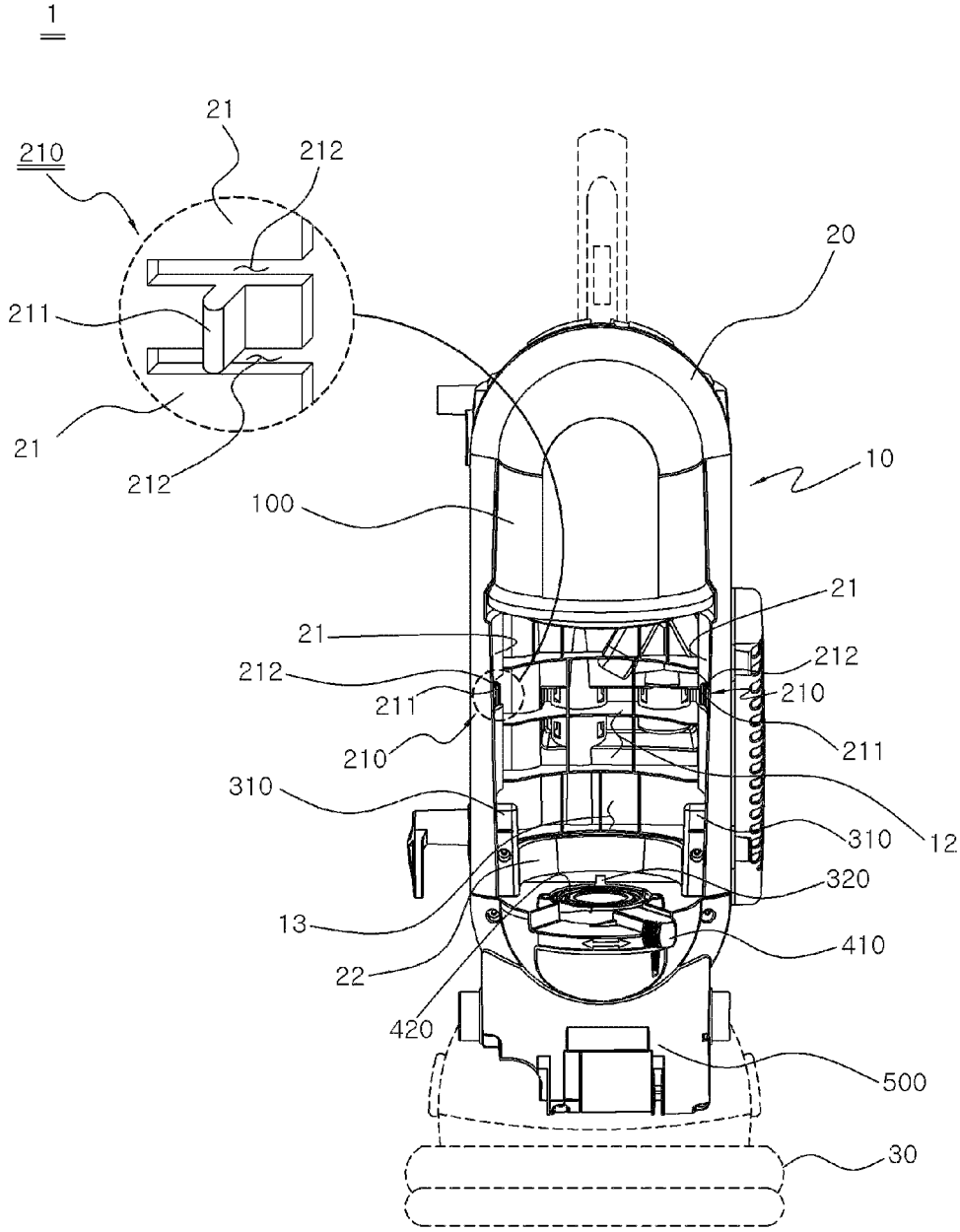
FIG. 3 is a front view illustrating the vacuum cleaner from which the dust bin and the filter casing are separated.

FIG. 3 illustrates a front view of an example of the vacuum cleaner 1 from which the dust bin 200 and the filter casing 300 may be separated.

Referring to FIG. 3, for example, the front cover 20 may support the centrifugal separating portion 100, and may be placed on a front surface of the main body 10 in a manner in which a lower open area of the centrifugal separating portion 100 may form the dust bin seating portion 12 and the filter casing seating portion 13 in order.

A side frame 21 may be recessed inwardly in the main body 10 on both sides of the front cover 20 which form the dust bin seating portion 12 and the filter casing seating portion 13 respectively.

The dust bin locking member 210 may be formed on both sides of the side frame 21 which contact the side of the dust bin seating portion 12, and the filter casing locking member 310 may be formed on both sides of the side frame 21 which contact the side of the filter casing seating portion 13.

The dust bin locking member 210 includes a dust bin locking protrusion 211 formed on a location corresponding to a first locking hole 201 of the dust bin 200 to be inserted into the first locking hole 201. The first locking hole 201 may be formed on both sides of the dust bin 200 in a vertical direction. The dust bin locking protrusion 211 includes cutaway portions on upper and lower portions, to enable the dust bin locking protrusion 211 to be elastically engaged with the first locking hole 201.

Accordingly, the elastic coupling of the dust bin locking member 210, enabled by the cutaway portions 212, may enable a user to mount the dust bin 200 on the dust bin seating portion 12 firmly, or to remove the dust bin 200 from the mounted position.

The filter casing locking member 310, extended vertically by a predetermined length, may protrude toward the center of the filter casing seating portion 13, from both ends of a filter casing support frame 22 in which a rounded portion of the filter casing support frame 22 is connected to a lower portion of the side frame 21 of the front cover 20. The filter casing locking member 310 may be inserted into a filter casing coupling hole 302 formed on both sides of a filter casing 300, as explained below, to thereby secure the filter casing 300 in place.

Additionally, a filter casing fixing rib 320 may protrude upwardly from a lower surface of the filter casing seating portion 13 of the main body 10 on which the fastening unit 400 is placed. The filter casing fixing rib 320 may be inserted into a fixing rib hole 321 of the filter casing 300, explained below, to fix the filter casing 300 in place, if the filter casing 300 is mounted on the filter casing seating portion 13.

Figure 4:
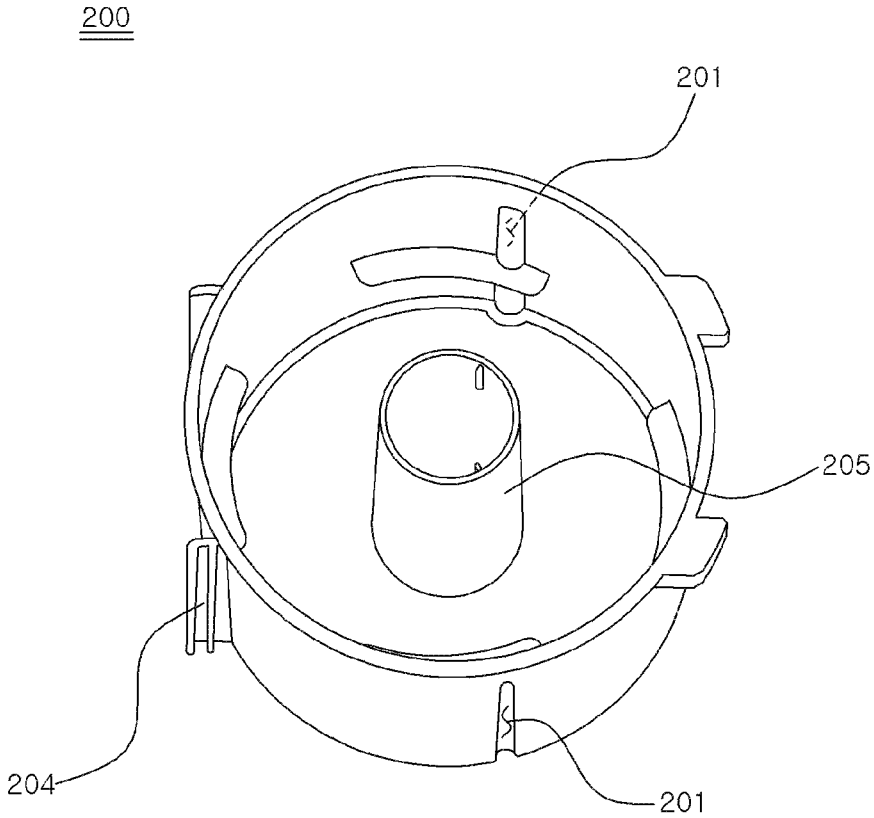
FIG. 4 is a perspective view illustrating an example of the dust bin coupled to the front cover by a dust bin locking member.

FIG. 4 illustrates a perspective view of the example of the dust receptacle 200 connected to the front cover 20 by the dust bin locking member 210 explained above.

Referring to FIG. 4, as an example, the dust bin 200 may have a cylindrical structure in which a dust bin discharging pipe 205 with open upper and lower portions is formed. A lower surface of the dust bin 20 having the dust bin discharging pipe 205 thereon may be closed. A handle 204 and the first locking hole 201 may be formed on an outer surface of the dust bin 200. The first locking hole 201 may be upwardly extended from a lower portion of the outer surface of the dust bin 200 which faces the dust bin locking protrusion 211 to a predetermined height.

Figure 5:
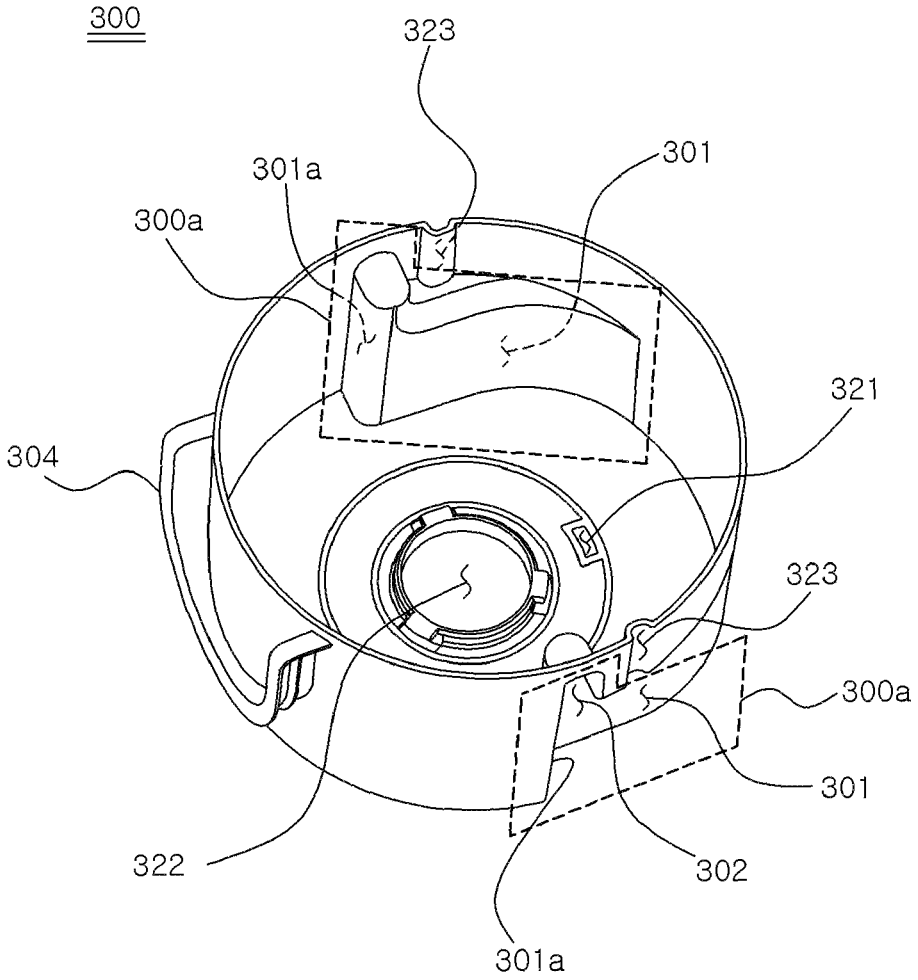
FIG. 5 is a perspective view illustrating an example of a filter casing connected to the front cover by a filter casing fixing rib.

FIG. 5 illustrates a perspective view of an example of a filter casing 300 connected to the front cover 20 by the filter casing locking member 310 and the filter casing fixing rib 320.

By way of example, FIG. 5 shows the filter casing 300 including a cylindrical structure with an open upper portion to house a pre-filter therein. A filter casing locking portion 300*a*, a second locking hole 323, and a filter casing handle 304 may be formed on an outer surface of the filter casing 300. A filter casing discharge port 322 and a fixing rib hole 321 may be formed on an inner lower surface of the filter casing 300. The lower area of the filter casing 300, excluding the area where the filter casing discharge port 322 and the fixing rib hole 321 are formed, may support the pre-filter and be closed to prevent or deter ingress of external air.

The filter casing locking portion 300*a* includes a guiding portion 301, a vertical end 301*a*, and a filter casing coupling hole 302.

The guiding portion 301 is formed in a manner in which the entire surface along which the filter casing locking member 310 is moved, is recessed inward from a lower portion of the filter casing coupling hole 302 to a predetermined depth of the filter casing 300 so as not to interfere with the filter casing locking member 310 during mounting or demounting of the filter casing 300.

The filter casing coupling hole 302 may be recessed from the front vertical end 301*a* of the guiding portion 301 so that an upper portion of the filter casing locking member 310 is inserted thereinto.

The second locking hole 323 at a location facing a lower portion of the first locking hole 201, may have the same width, depth and direction as the first locking hole 201, and is recessed in a vertical direction to have a predetermined length. The second locking hole 323 with the above-mentioned structure may form an integral hole with the first locking hole 201 in which the filter casing 300 and the dust bin 200 are firmly secured by the fastening unit 400, to thereby prevent or deter a gap from forming in between the dust bin 200 and the filter casing 300 connected to each other.

The fixing rib hole 321 may be pierced in a location corresponding to the upper portion of the filter casing fixing rib 320. Accordingly, if the filter casing 300 is seated on the filter casing seating portion 13, the filter casing fixing rib 320 is inserted to securely support the filter casing 300 so that the filter casing 300 is not separated from the main body 10.

In the vacuum cleaner 1 with the above-mentioned structure, the dust bin 200 and the filter casing 300 may be mounted and demounted to and from the main body 10 individually.

The process of mounting the dust bin 200 and the filter casing 300 to the main body 10 is explained below.

In order to mount the dust bin 200, the user may insert the dust bin 200 into the dust bin seating portion 12 using the dust bin handle 204.

If the dust bin is inserted to the extent that the first locking hole 201 faces the dust bin locking protrusion 211, the dust bin locking protrusion 211 is brought into close contact with the first locking hole 201 by the elastic recovery force of the dust bin locking member 210.

The dust bin locking protrusion 211 in the locked state may be moved from upper to lower portions of the first locking hole 201, so that it is possible for the user to move the dust bin 200 vertically for a predetermined distance, while the dust bin 200 is mounted in the main body 10.

Next, to mount the filter casing 300, the user may grab the filter casing handle 304 and insert the filter casing 300 into the filter casing seating portion 13.

If the filter casing 300 is inserted, the filter casing locking member 310 at both sides of the filter casing 300 may be moved along the guiding portion 301 and brought into a contact with the vertical end 301*a* of the guiding portion 301.

If the user releases the filter casing handle 304 while the filter casing locking member 310 is in contact with the vertical end 301*a*, an upper portion of the filter casing locking member 310 may be inserted into the filter casing coupling hole 302, and the filter casing fixing rib 320 may be inserted into the fixing rib hole 321. As a result, the filter casing 300 may be securely connected to the main body 10 so that undesired separation of the filter casing 300 is prevented or deterred.

Since the filter casing locking member 310 may also be vertically moved within a range corresponding to the vertical length of the filter casing coupling hole 302, the user may be able to move the filter casing 300 for a predetermined distance while the filter casing 300 is in a mounted state.

As explained above, after the dust bin 200 and the filter casing 300 are mounted in the main body 10, the upper surface of the filter casing 300 may be brought into a tight and secure contact with the lower surface of the dust bin 200 as the fastening lever 410 of the fastening unit 400 is upwardly moved.

Figure 6:
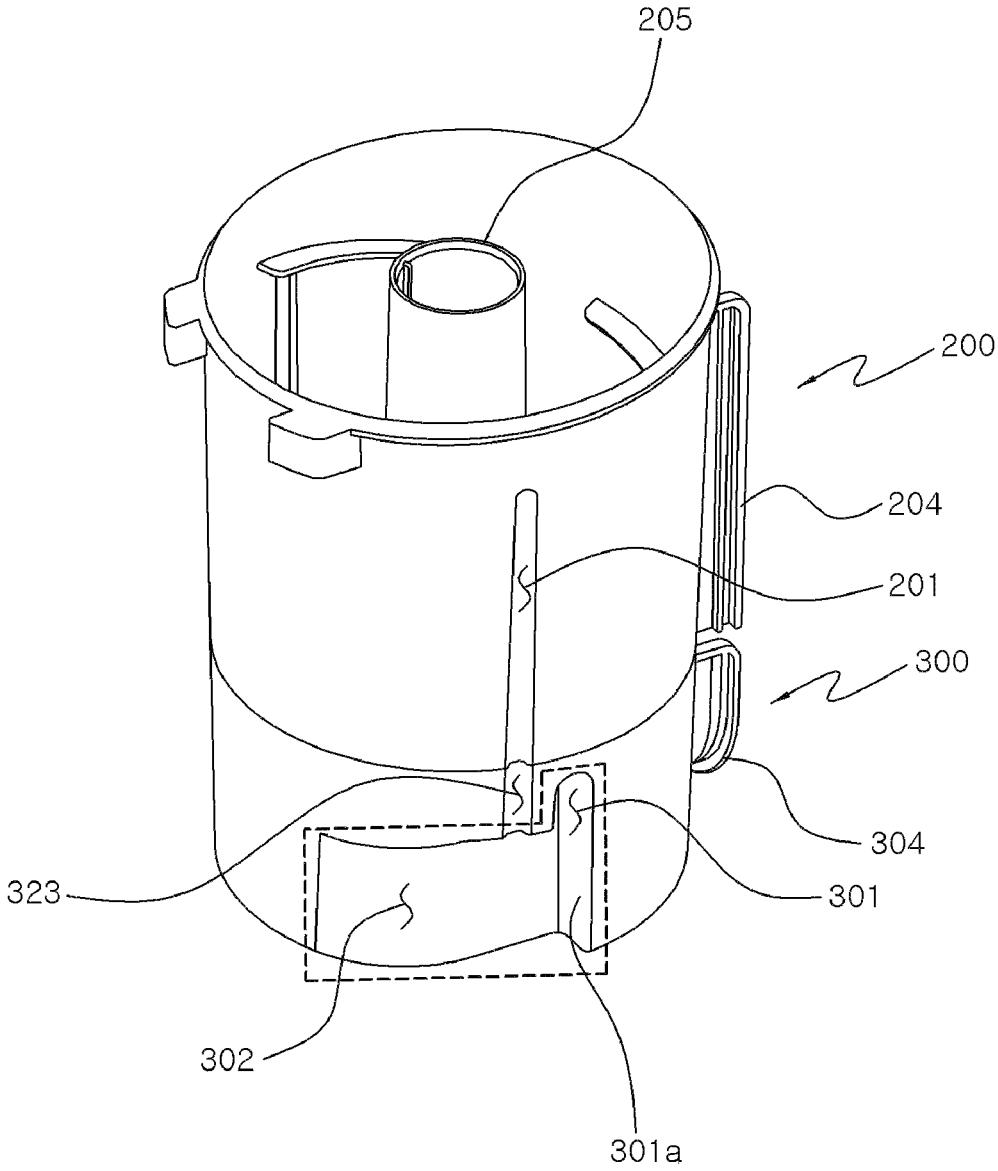
FIG. 6 is a perspective view illustrating an example of the dust bin and the filter casing closely secured to each other by a fastening unit.

FIG. 6 illustrates a perspective view of an example of the dust bin 200 and the filter casing 300 which are connected to each other tightly and securely by the fastening unit 400.

If the dust bin 200 and the filter casing 300 are firmly secured to each other in a vertical direction by the fastening unit 400, each of the fastening holes 323 may form an integral hole with each of the first locking holes 201, thereby preventing or deterring the formation of a gap between lower portion of the dust bin 200 and upper portion of the filter casing 300. Accordingly, the lower portion of the dust bin 200 and the upper portion of the filter casing 300 may be kept in a seamless, secure surface contact with each other.

As explained above, the user may selectively separate the dust bin 200 or the filter casing 300 as desired, while keeping the dust bin 200 and the filter casing 300 in a firmly secured contact with the main body 10 of the vacuum cleaner 1.

To separate the dust bin 200 from the vacuum cleaner 1, the user may release the dust bin 200 and the filter casing 300 from the secure fastening by the fastening unit 400, by rotating the fastening lever 410 to a direction where the fastening supporting portion 420 is moved in a downward direction. After that, the user may grab the dust bin handle 204 and forcibly separate the dust bin 200 from the main body 10, such that the dust bin locking protrusion 211 is released from the first locking hole 201.

To separate the filter casing 300 while keeping the dust bin 200 in the locked state, the user may lift the filter casing 300 upwardly for a predetermined distance while unfastening the fastening unit 400. Accordingly, the upper portion of the filter casing locking member 310 is separated from the filter casing coupling hole 302, and the locking status is released. If the user pulls the filter casing 300 in a state that the filter casing 300 is unfastened, the filter casing 300 is separated from the filter casing seating portion 13, and the dust bin 200 remains in its position.

The first locking hole 201 and the filter casing coupling hole 302 may be formed in a manner in which a predetermined gap is created between the dust bin 200 and the filter casing 300 when the dust bin 200 and the filter casing 300 are unfastened, to facilitate individual mounting and demounting of the dust bin 200 and the filter casing 300.

Further, as explained above, the dust bin 200 and the filter casing 300, which are unfastened from the fastening unit 400 for mounting or demounting purposes, may be prevented from separating from the main body 10 due to a dual locking structure even when the vacuum cleaner 1 is tilted.

Further describing the above, the dust bin locking protrusion 211, unfastened from the fastening unit 400, may remain inserted into the first locking hole 201 due to the weight of the dust bin 200. Likewise, the upper portion of the filter casing locking member 310 may also remain inserted into the filter casing coupling hole 302 due to the weight of the filter casing 300. Accordingly, the dust bin 200 and the filter casing 300, which are in unfastened state, are not separated from the vacuum cleaner 1 even when the vacuum cleaner 1 is tilted.

As explained above, since it is possible to separate and mount the dust bin and the filter casing from and to the vacuum cleaner, cleaning of the dust bin, or filter maintenance becomes convenient and easy.

Further, since the dust bin and the filter casing in unfastened state are prevented or deterred from separating from the vacuum cleaner even when the vacuum cleaner is tilted, the vacuum cleaner may have increased user safety and hygienic condition.

Further, a simplified dual locking structure for the dust bin, the filter casing, and the vacuum cleaner is provided, to prevent or deter separating of the dust bin and the filter casing in an unfastened state from the vacuum cleaner.

A number of examples of embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A vacuum cleaner, comprising:

a brush assembly to contact a surface to be cleaned and to suction air containing dusts;

a main body connected to the brush assembly;

the main body comprising:

a fan motor unit to generate a suction force upon the brush assembly;

a centrifugal separating portion to separate dusts from air stream suctioned through the brush assembly;

a dust collection unit-seating portion provided below the centrifugal separating portion to mount a dust collection unit therein, the dust collection unit receiving the dusts separated by the centrifugal separating portion; and a fastening unit installed on a bottom of the dust collection unit-seating portion to ascend or descend the dust collecting unit by a manual operation so that the dust collection unit is fixed to or separated from the dust collection unit-seating portion, wherein locking protrusions are provided at opposite sides of the dust collection unit-seating portion, the locking protrusions being protruded vertically inward the dust collection unit-seating portion, wherein locking holes are provided at the opposite sides of the dust collection unit to correspond to the locking protrusions, the locking holes being recessed from an outer surface of the dust collection unit, whereby when the dust collection unit has been descended in the dust collection unit-seating portion due to the weight of the dust collection unit by an operation of the fastening unit, the dust collection unit is separated from the fastening unit and suspended to the dust collection unit-seating portion in a state that the locking protrusions of the dust collection unit-seating portion are inserted into the locking holes of the dust collection unit.

2. The vacuum cleaner of claim 1, wherein locking protrusion guiding portions are provided at the outer surface of the dust collection unit so as not to interfere with the locking protrusions when the dust collection unit is seated in the dust collection unit-seating portion, the locking protrusion guiding portions being recessed inward from a lower portion of the dust collection unit.

3. The vacuum cleaner of claim 1, wherein the dust collection unit comprises a dust bin disposed just below the centrifugal separation portion to collect dusts separated by the centrifugal separating portion, and a filter casing disposed below the dust bin to filter minute particles from air from which the dusts are removed from the centrifugal separating portion.

4. The vacuum cleaner of claim 3, wherein the locking protrusions formed at the dust collection unit-seating portion comprise dust bin locking protrusions to fix the dust bin to the dust collection unit-seating portion, and the locking holes formed at the dust collection unit comprise dust bin locking holes into which the dust bin locking protrusion is inserted.

5. The vacuum cleaner of claim 3, wherein the dust bin comprises a dust bin discharging pipe to discharge dust-removed air to the filter casing.

6. The vacuum cleaner of claim 3, wherein the filter casing comprises a pre-filter to filter the minute particles.

7. The vacuum cleaner of claim 6, wherein air which has passed through the pre-filter received in the filter casing flows to the fan motor unit of the main body.

* * * * *